US008117753B2

(12) United States Patent
Gilder et al.

(10) Patent No.: US 8,117,753 B2
(45) Date of Patent: Feb. 21, 2012

(54) SAFETY RAZORS

(75) Inventors: Bernard Gilder, Tywford (GB); Ian Saker, Reading (GB)

(73) Assignee: The Gillette Company, Boston, MA (US)

( * ) Notice: Subject to any disclaimer, the term of this patent is extended or adjusted under 35 U.S.C. 154(b) by 16 days.

(21) Appl. No.: 12/795,791

(22) Filed: Jun. 8, 2010

(65) Prior Publication Data

US 2010/0269351 A1 Oct. 28, 2010

Related U.S. Application Data

(60) Division of application No. 12/330,661, filed on Dec. 9, 2008, now abandoned, which is a division of application No. 11/217,985, filed on Sep. 1, 2005, which is a continuation of application No. 10/964,581, filed on Oct. 13, 2004, now abandoned, which is a continuation of application No. 10/602,894, filed on Jun. 24, 2003, now abandoned, which is a continuation of application No. 10/102,692, filed on Mar. 22, 2002, now abandoned, which is a continuation of application No. PCT/GB00/03690, filed on Sep. 26, 2000.

(30) Foreign Application Priority Data

Sep. 27, 1999 (GB) ..... 9922832.2

(51) Int. Cl.
*B26B 21/00* (2006.01)

(52) U.S. Cl. ..... 30/50

(58) Field of Classification Search ..... 30/41, 41.5, 30/50, 57

See application file for complete search history.

(56) References Cited

U.S. PATENT DOCUMENTS

| | | | |
|---|---|---|---|
| 1,920,711 | A | 8/1933 | Pelizzola |
| 3,137,940 | A | 6/1964 | Curci |
| 3,660,893 | A | 5/1972 | Welsh |
| 4,168,571 | A | 9/1979 | Francis |
| 4,170,821 | A | 10/1979 | Booth |
| 4,177,556 | A | 12/1979 | Galli, Jr. |
| 4,200,976 | A | 5/1980 | Gooding |
| 4,302,876 | A | 12/1981 | Emmett |
| 4,516,321 | A | 5/1985 | Francis |
| 4,709,477 | A | 12/1987 | Ferraro |
| 4,774,765 | A | 10/1988 | Ferraro |

(Continued)

FOREIGN PATENT DOCUMENTS

CA 1155643 * 7/1981

(Continued)

OTHER PUBLICATIONS

SNL Archives I (Platinum Mach 14), May 2000.

(Continued)

*Primary Examiner* — Jason Daniel Prone

(74) *Attorney, Agent, or Firm* — Kevin C. Johnson; Steven W. Miller

(57) ABSTRACT

A safety razor blade unit has two or more blades (19,20,21) with parallel cutting edges (24,25,26) mounted in a frame (10) between guard and cap surfaces so that the average inter-blade span is not greater than 1.25 mm, and the wash through index, a measure of the rinsability obtained by a method defined in the specification, is not less than 0.20. The combination of narrow inter-blade spans and good rinsability enables enhanced comfort levels during shaving to be achieved.

7 Claims, 6 Drawing Sheets

U.S. PATENT DOCUMENTS

| | | | | | |
|---|---|---|---|---|---|
| 4,932,122 | A | * | 6/1990 | Shurland et al. | 30/50 |
| 4,941,492 | A | | 7/1990 | Morgan | |
| 5,056,222 | A | | 10/1991 | Miller et al. | |
| 5,067,238 | A | * | 11/1991 | Miller et al. | 30/50 |
| 5,084,969 | A | | 2/1992 | Althaus | |
| 5,113,585 | A | | 5/1992 | Rogers et al. | |
| 5,141,694 | A | | 8/1992 | Butlin et al. | |
| 5,191,712 | A | | 3/1993 | Crook et al. | |
| 5,222,300 | A | * | 6/1993 | Althaus et al. | 30/50 |
| 5,224,267 | A | * | 7/1993 | Simms et al. | 30/50 |
| 5,236,439 | A | | 8/1993 | Kozikowski | |
| 5,249,361 | A | | 10/1993 | Apprille, Jr. et al. | |
| 5,253,420 | A | * | 10/1993 | Althaus et al. | 30/50 |
| 5,265,337 | A | | 11/1993 | Lowder | |
| 5,313,706 | A | * | 5/1994 | Motta et al. | 30/50 |
| 5,335,417 | A | | 8/1994 | Genero et al. | |
| 5,369,885 | A | * | 12/1994 | Ferraro | 30/50 |
| 5,402,574 | A | | 4/1995 | Milner | |
| 5,426,851 | A | | 6/1995 | Gilder et al. | |
| 5,497,550 | A | | 3/1996 | Trotta et al. | |
| 5,537,749 | A | | 7/1996 | Cacioppo | |
| 5,666,729 | A | | 9/1997 | Ferraro | |
| 5,671,534 | A | * | 9/1997 | Mayerovitch | 30/50 |
| 5,689,883 | A | | 11/1997 | Ortiz et al. | |
| 5,711,076 | A | | 1/1998 | Yin et al. | |
| 5,813,119 | A | | 9/1998 | Ferraro et al. | |
| 5,893,213 | A | | 4/1999 | Motta | |
| 5,953,824 | A | | 9/1999 | Ferraro et al. | |
| 5,953,825 | A | | 9/1999 | Christman et al. | |
| 5,966,822 | A | | 10/1999 | Coffin et al. | |
| 6,009,623 | A | | 1/2000 | Orloff | |
| 6,014,918 | A | | 1/2000 | Orloff | |
| 6,026,577 | A | | 2/2000 | Ferraro | |
| 6,055,731 | A | | 5/2000 | Zucker | |
| 6,082,007 | A | | 7/2000 | Andrews | |
| RE36,816 | E | * | 8/2000 | Apprille et al. | 30/50 |
| 6,112,412 | A | | 9/2000 | Richard | |
| 6,122,826 | A | | 9/2000 | Coffin et al. | |
| 6,138,361 | A | | 10/2000 | Richard et al. | |
| 6,141,875 | A | * | 11/2000 | Andrews | 30/50 |
| 6,161,288 | A | | 12/2000 | Andrews | |
| 6,173,498 | B1 | | 1/2001 | Warrick et al. | |
| 6,182,365 | B1 | | 2/2001 | Tseng et al. | |
| 6,185,823 | B1 | | 2/2001 | Brown et al. | |
| 6,212,777 | B1 | | 4/2001 | Gilder et al. | |
| 6,216,349 | B1 | | 4/2001 | Gilder et al. | |
| 6,243,951 | B1 | * | 6/2001 | Oldroyd | 30/50 |
| 6,276,061 | B1 | | 8/2001 | Rozenkranc | |
| 6,295,734 | B1 | | 10/2001 | Gilder et al. | |
| 6,298,559 | B1 | | 10/2001 | Kwiecien et al. | |
| 6,301,785 | B1 | | 10/2001 | Kwiecien et al. | |
| 6,311,400 | B1 | | 11/2001 | Hawes et al. | |
| 6,397,473 | B1 | * | 6/2002 | Clark | 30/50 |
| 6,434,828 | B1 | | 8/2002 | Andrews | |
| 6,499,218 | B2 | | 12/2002 | Rocha | |
| 6,502,318 | B1 | | 1/2003 | Gilder | |
| 6,601,303 | B2 | * | 8/2003 | Gilder et al. | 30/50 |
| 6,671,961 | B1 | * | 1/2004 | Pragt et al. | 30/50 |
| 7,007,390 | B2 | | 3/2006 | Mislove | |
| 7,043,842 | B1 | | 5/2006 | Taylor et al. | |
| 7,047,646 | B2 | | 5/2006 | Coffin | |
| 7,100,284 | B2 | * | 9/2006 | King | 30/50 |
| 2002/0088122 | A1 | * | 7/2002 | Zuidervaart | 30/50 |
| 2002/0144404 | A1 | | 10/2002 | Gilder et al. | |
| 2004/0060176 | A1 | | 4/2004 | Gilder et al. | |
| 2004/0200074 | A1 | * | 10/2004 | Gilder et al. | 30/50 |
| 2004/0221455 | A1 | | 11/2004 | Coffin | |
| 2005/0015991 | A1 | | 1/2005 | Follo et al. | |
| 2005/0108882 | A1 | * | 5/2005 | Gilder et al. | 30/50 |
| 2006/0026842 | A1 | * | 2/2006 | Gilder et al. | 30/50 |
| 2006/0101647 | A1 | | 5/2006 | Gilder et al. | |
| 2006/0277759 | A1 | * | 12/2006 | Follo | 30/50 |
| 2007/0011880 | A1 | * | 1/2007 | Pennell et al. | 30/50 |
| 2009/0126196 | A1 | * | 5/2009 | Gilder et al. | 30/50 |
| 2010/0077619 | A1 | * | 4/2010 | Follo et al. | 30/50 |
| 2010/0229398 | A1 | * | 9/2010 | Coffin | 30/50 |
| 2011/0289779 | A1 | * | 12/2011 | Volodin et al. | 30/50 |

FOREIGN PATENT DOCUMENTS

| | | | | |
|---|---|---|---|---|
| EP | 0 073 852 | | | 3/1983 |
| EP | 0 259 065 | | | 3/1988 |
| EP | 0 336 355 | B1 | | 10/1989 |
| EP | 760734 | A1 | * | 3/1997 |
| GB | 1 362 443 | | | 8/1974 |
| GB | 2 087 288 | A | | 5/1982 |
| GB | 2 117 304 | A | | 10/1983 |
| GB | 2 354 474 | | | 3/2001 |
| JP | 2007083084 | A | * | 4/2007 |
| WO | WO 9217322 | A1 | * | 10/1992 |
| WO | WO 95/09071 | | | 4/1995 |
| WO | WO 9629183 | A1 | * | 9/1996 |
| WO | WO 97/25190 | | | 7/1997 |
| WO | WO 97/33728 | | | 9/1997 |
| WO | WO 97/33729 | | | 9/1997 |
| WO | WO 97/37819 | | | 10/1997 |
| WO | WO 98/35795 | | | 8/1998 |
| WO | WO 98/36880 | | | 8/1998 |
| WO | WO 98/38017 | | | 9/1998 |
| WO | WO 99/14020 | | | 3/1999 |
| WO | WO 99/16591 | | | 4/1999 |
| WO | WO 99/16592 | | | 4/1999 |
| WO | WO 99/39883 | | | 8/1999 |
| WO | WO 00/37227 | | | 6/2000 |

OTHER PUBLICATIONS

Razor Wars: 15-blade fever, Nov. 2005.
Gillette Lightspeed Razor, Jan. 2006.

* cited by examiner

SAFETY RAZORS

This application is a divisional of U.S. application Ser. No. 12/330,661, filed on Dec. 9, 2008, now abandoned which is a divisional of U.S. application Ser. No. 11/217,985, filed on Sep. 1, 2005, which is a continuation (and claims the benefit of priority under 35 U.S.C. §120) of U.S. application Ser. No. 10/964,581, filed on Oct. 13, 2004, now abandoned which is a continuation of U.S. application Ser. No. 10/602,894, filed on Jun. 24, 2003, now abandoned which is a continuation of U.S. application Ser. No. 10/102,692, filed on Mar. 22, 2002, now abandoned which is a continuation of PCT/GB00/03690, filed on Sep. 26, 2000, which claims priority from United Kingdom application serial no. 9922832.2, filed on Sep. 27, 1999.

This invention is concerned with safety razors and more especially the invention is concerned with a safety razor blade unit in which there are two or more blades with substantially parallel sharpened edges disposed to contact the skin between a front guard surface and a rear cap surface as the blade unit is moved across the skin in the performance of a shaving stroke. A safety razor blade unit can be mounted permanently on a handle with the intention that the entire razor should be discarded when the blade edges have become dulled. Alternatively a safety razor blade unit may be detachably mounted to a handle so that the blade unit can be replaced on the handle when the blades have lost the sharpness required for efficient shaving. Replaceable blade units are commonly referred to as shaving cartridges. In modern safety razor blade units the blades are usually carried by a moulded plastics frame, and the blades can be supported to move within the frame, either independently of each other or in unison under forces imparted on the blades by the skin during shaving. The frame of the blade unit can itself define the guard surface which contacts the skin immediately ahead of the blades and/or the cap surface which contacts the skin directly behind the blades during a shaving stroke, but the guard and/or the cap may comprise an additional element carried by the frame. In one particular construction a guard element of elastomeric material e.g. with upwardly directed fins, with an array of cylindrical recesses or sockets, or with other forms of protrusions is provided on the guard and can have a beneficial influence by interacting with hairs and/or by producing a pleasant tactile sensation during movement over the skin, whereas the blade unit cap includes a strip of material containing a shaving enhancement product, such as a lubricant which gradually leaches out of the strip material during shaving.

There are many factors which influence the shaving performance of a safety razor, and there is a variety of characteristics which can be considered in making a determination of the performance, including the closeness of the shave produced, the comfort during shaving, and the safety level in terms of the numbers of small nicks and cuts suffered. Changing features to enhance one characteristic often have a counter-productive effect on other characteristics and in deciding upon a blade unit design for manufacture and marketing a compromise must always be reached as to the characteristics which the blade unit produced is to have. A very fundamental consideration in the design of a safety razor blade unit is the number of blades. In former years the vast majority of safety razors available on the market had a single blade, this despite the fact that there have been several proposals in patent specifications going back many years for safety razors to be equipped with two or more blades. More recently it has been common for safety razor blade units to have a pair of tandem blades, and during the last couple of years safety razors having blade units equipped with three blades have come onto the market. The reason for safety razors having more than one blade taking so long to become a commercial reality was the very poor comfort level found with early prototype razors fitted with a plurality of blades and in particular such razors suffered from unacceptably high drag properties and hence very poor comfort levels. As technology developed and detailed understanding of the shaving process improved, it was then found possible to reduce the drag and thereby to achieve an adequate level of comfort while having two blades, and continuation of this development process has resulted in razors with three blades now being in commercial production and available on the market.

The level of comfort obtained with any given safety razor blade unit is influenced strongly by the so-called shaving geometry, which is the relative positioning of the skin contacting components. Important parameters of the shaving geometry include the blade exposure which is the distance by which the tip of the blade edge projects above, or is retracted below, a plane which is tangential to the skin contacting parts next in front and next behind the blade edge, the blade tangent angle (also known as the blade shaving angle) which is the angle at which the plane of the blade is inclined to a plane which is tangential to the guard and the cap surfaces (the tangent plane), and the blade span which is the distance by which the blade edge is spaced from the skin contacting element immediately in front of the blade edge, as seen in a plane which is tangential to the blade edge and the skin contacting element in front of it. In a blade unit having two or more blades, the blade span of the or each blade after the forwardmost or primary blade will in general be the distance from the edge of that blade to the edge of the blade immediately in front of that blade. Thus, for these subsequent blades it is convenient to refer to the "inter-blade span".

Quite naturally persons working in the field of research and development related to safety razors have studied the effect which changing the blade span can have on the comfort characteristics. Shown in FIG. 1 is a graph plotting the results of a series of shaving trials performed in accordance with established shave test protocols and carried out with blade units having different blade spans, the blade span in mm being plotted on the abscissa and the "score", an indication of preference expressed by the persons involved in the trials, being plotted on the ordinate. The dip 1 in the upper portion of the curve is not fully understood and is not believed to be of particular significance, but the graph provides a very strong indication that very acceptable shave comfort can be expected if the blade span is in the range of about 0.6 mm to about 1.5 mm and that a blade span around 0.7 mm is likely to be most beneficial. The blade span to some extent at least determines the size of the skin bulge which forms naturally immediately in front of the blade edge as the blade unit is moved over the skin during shaving, and the size of the skin bulge has a strong influence on the drag characteristic. From a theoretical viewpoint, these considerations should apply equally to all blades in blade units having more than one blade. It is not surprising, therefore, that there have been proposals to arrange the blade span of the second blade, and in a few cases also a third blade, as well as the first blade in the blade unit, to be in the range of from about 0.5 to about 2.0 mm, as disclosed for example in GB-A-1362443, U.S. Pat. No. 3,660,893, EP-A-0073852 and WO 095/09071. While it might also be predicted from the foregoing desiderata that two- and three-bladed safety razor blade units manufactured for sale would have inter-blade spans and primary blade spans of around 0.7 mm, this has not in fact been the case, even though a small inter-blade span would also be desirable for compactness reasons. For the most part two- and three-bladed blade units produced and marketed by The Gillette Company have had a primary blade span of about 0.7 mm, but the inter-blade span has been around 1.5 mm despite the fact that larger inter-blades were to be expected to compromise the comfort levels achieved.

It has now been realised that the comfort benefits resulting from narrow spans as perceived during earlier laboratory trials can only be achieved in practice in a multi-bladed razor if satisfactory provision is made for clearance of debris between the blades. The effective clearance of shaving debris, i.e. cut hairs, shaving soap, skin particles, etc, from the underside of the first blade is usually ensured when there is a primary blade span of about 0.7 mm, but debris clearance between two blades is impeded by the more forward blade which inevitably occupies some of the space as it needs to be of a certain width and requires a blade support which carries the blade within the blade unit frame and further restricts the space between the blades. The need for good rinsing properties to facilitate the removal of shaving debris from a blade unit has been recognised for a long time, but as far as is currently known the extent to which blade unit performance has been directly influenced by the debris clearance efficiency or "rinsability", especially in the area between successive blades, has gone unnoticed by practitioners working in the shaving field.

The Applicants have developed a method of measuring the rinsability of safety razor blade units to provide a quantative assessment which permits a direct comparison of the inter-blade rinsing efficiency, the measurements providing a "wash through index" value, the precise meaning of which will become clear from the following description of the measurement method which is given with reference to FIG. 2 of the accompanying drawings.

Wash Through Index Measurement

A header tank 5 having a opening in the bottom wall 6 and an overflow outlet 7 at a predetermined height h of 185 mm above the bottom wall is provided.

The blade unit 2 to be tested is mounted to the underside of the bottom wall at the opening therein and the frame of the blade unit 2 is sealed to the bottom wall 6 around the opening. Prior to mounting the blade unit 2 in place for testing, all flow paths by which fluid can flow through the blade unit, from top to bottom, except by passing between two blades, are closed off by filling with suitable stopping material. In particular, the gap between the first blade and the guard is blocked (as satisfactory rinsing through the region is not generally a problem) and any gap between the final blade and the cap is blocked since any flow through this gap will not contribute to any material extent to the removal of shaving debris which collects principally in front of and beneath the blades. Water is supplied to the open top of the header tank 5 at a sufficient flow rate for the header tank to fill to the level of the overflow outlet 7, and when water starts to flow from this overflow outlet, the water which flows out through the opening in the bottom wall and through the blade unit during a certain period of time, in particular 10 seconds, is collected in a container 8 and is then weighed on a balance 9. The weight of water collected in the container is used to obtain a measure of the "wash through rate" in litres/min for the particular blade unit 2 being tested. To achieve a "normalised" measurement enabling results obtained with blade units of different shapes and sizes (length and width) and with different numbers of blades, to be compared directly, the test as described above is repeated but with the blade unit 2 replaced by a normalising plate having had cut therein a rectangular hole with a length equal to the length of the blades in the blade unit and a width equal to the distance between the sharpened edges of the first and the last blades in the blade unit. From the wash through rate obtained with the blade unit and the wash through rate obtained with the normalising plate corresponding to that blade unit, a "wash through index" value for the particular blade unit is calculated by the equation:—

$$\text{Wash Through Index} = \frac{\text{Wash Through Rate for Blade Unit}}{\text{Wash Through Rate for Normalising Plate}} \quad (1)$$

For the purposes of the present specification the term "wash through index" is defined to be the value obtained by following the test procedure described above and by calculating the value by means of Equation (1).

The wash through indices have been determined for several razor blade units which are currently marketed. It will be appreciated that a high wash through index means good inter-blade rinsability and a low wash through index is indicative of poor inter-blade rinsability. Also, with larger inter-blade spans it can be expected that a higher wash through index can be achieved, although increasing the inter-blade span will detract from other important shaving performance characteristics, such as comfort, as well as having the detrimental effect of making the blade unit as a whole larger. Shown graphically in FIG. 3 are the results of the wash through index determinations, the wash through index being shown plotted against the average inter-blade span. In the case of a two-bladed blade unit the average inter-blade span is the actual span or distance between the cutting edges of the two blades, and for blade units with three or more blades the average inter-blade span is the distance from the cutting edge of the first blade to the cutting edge of the final blade divided by the member of blades less 1. The blade units tested are identified by the names under which they are marketed in the panel at the bottom of FIG. 3, except that those referred to in the panel as "Embodiments 1 & 2" and "Embodiment 3" are blade units constructed in accordance with the present invention and have not been previously known or suggested. Of the prior art blade units, the Asda Tri-Flex, Kai 3 and Mach 3 each have three blades, whereas the remainder have two blades. It can be observed that most of the known blade units have an average inter-blade span of around 1.5 mm, the one notable exception being the Kai 3 which has an average inter-blade span of around 0.95 mm, but has a low wash through index. The wash through indices for the blade units with an average inter-blade span of about 1.5 mm vary over a wide range and this in itself is an indication that rinsability is an aspect which has not generally been given as much attention as it could have been and the significance of which during shaving has not been fully appreciated.

It has now been realised that the best compromise as between the characteristics of rinsability and of comfort during shaving, which is available through selection of inter-blade span dimensions, has been missed by the prior art blade units and constructions which can achieve a superior overall shaving performance can be reached. Having regard to the foregoing there is provided in accordance with the present invention a safety razor blade unit comprising a frame with a guard and a cap and two or more blades with spaced substantially parallel sharpened edges, wherein the average inter-blade span is not greater than 1.25 mm, and the wash through index (as hereinabove defined) of the blade unit is not less than 0.20. The stipulated maximum average inter-blade span and minimum wash through index are depicted by dashed lines in FIG. 3.

It is believed possible to achieve a wash through index of up to 0.35 and it is preferable for the wash through index to be at least 0.25. From a consideration of FIG. 1 it is unlikely that an average span less than about 0.7 mm would be beneficial, and the preferred range for the average inter-blade span is from 0.70 to 1.20 mm.

Preferred embodiments of the invention have at least three blades and in such embodiments it is preferable for the individual inter-blade spans to be substantially equal. Especially good results have been observed with blade units having three blades with an average inter-blade span of 1.05 to 1.15 mm, more precisely about 1.10 mm, and a wash through index of more than 0.275, more especially above 0.30. In addition, it has been found possible for a four-bladed blade unit to be assembled without becoming unduly large, enabling enhanced closeness to be obtained whilst the specified preferred minimum wash through index of 0.25 is exceeded and a average inter-blade span less than 1.20 mm ensures adequate comfort during shaving.

In blade units embodying the invention it is preferable that the blade span of the first or primary blade be less than the inter-blade span, and the primary blade span will preferably be from 0.6 to 0.9 mm, most ideally substantially equal to about 0.7 mm. Conveniently, the blades are substantially planar metal strips having a width less than the average inter-blade span, and mounted on elongate supports which are narrower than, and do not protrude rearwardly of the rear edges of, the respective blade strips. Suitably each blade support has the form of a bar with parallel front and rear faces, a bottom face perpendicular to the front and rear faces, and a top face which is inclined at an angle of 65° to 75° e.g. about 67.5°, to the front face so that the blade mounted on the top face will be set in an upwardly and forwardly inclined orientation. The blades are preferably movable independently of each other and for this purpose the ends of the support bars can be guided in slots in the ends of the blade unit frame. Springs can be arranged to act on the blade support bars to urge the blade upwardly to a normal rest position.

To assist a clear understanding of the invention some currently preferred embodiments are described below with reference to the accompanying drawings in which:—

Figure 4:
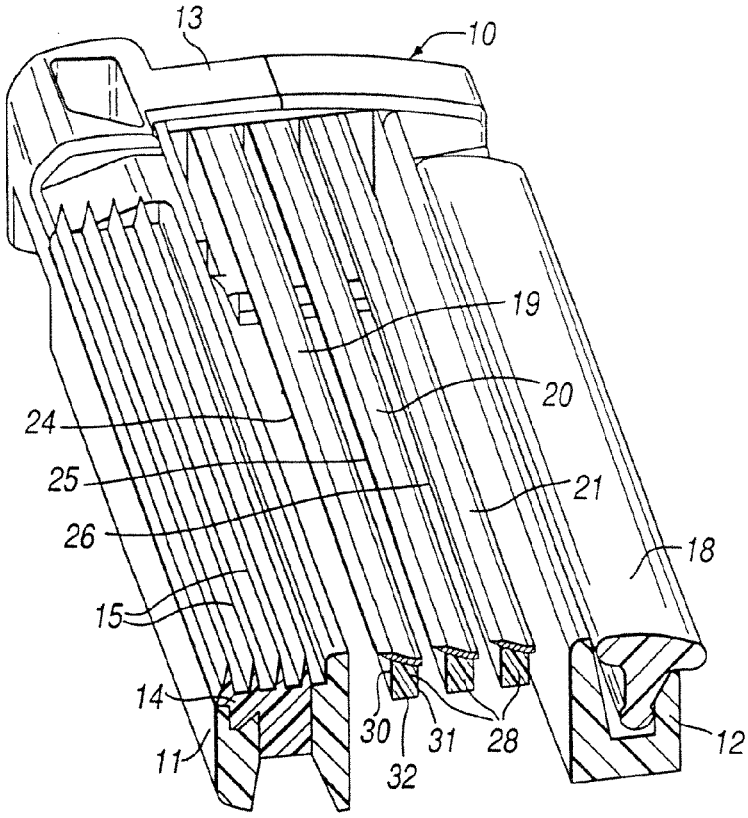
FIG. 4 is a half sectioned perspective view of a first three-bladed safety razor blade unit in accordance with the invention.
Figure 5:
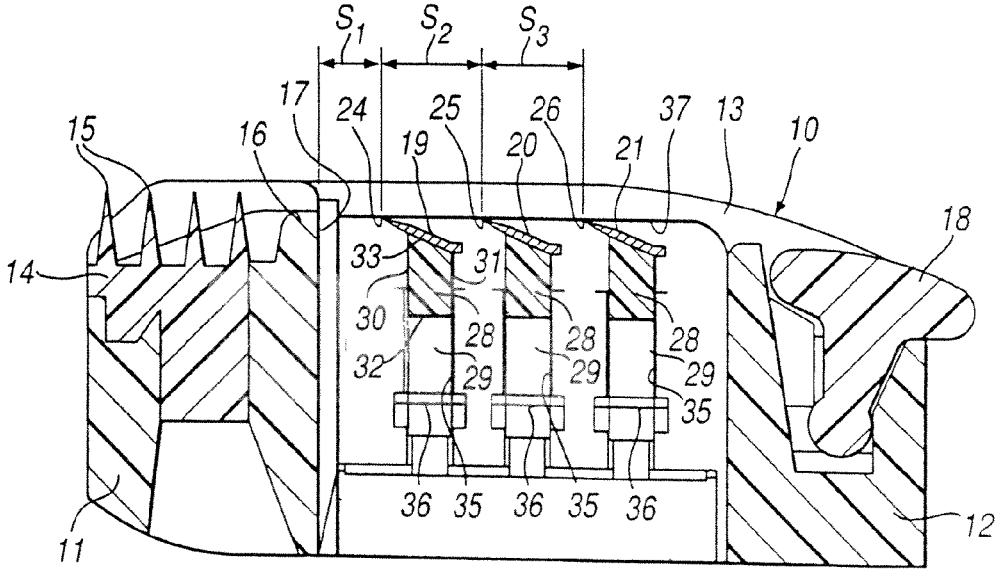
FIG. 5 is a transverse cross-section through the blade unit of FIG. 4.

The safety razor blade unit illustrated in FIGS. 4 and 5 is a shaving cartridge or at least part of a shaving cartridge, which in use is mounted on a razor handle and is capable of pivoting about an axis disposed forwardly of the blades. The blade unit includes a rectangular moulded plastic frame 10 with longitudinal front and rear members 11, 12 interconnected by frame ends 13. The front member 11 carries a strip 14 of elastomeric material which may be moulded in situ and, as shown, has a series of upstanding parallel fins 15. The guard strip may have other surface configurations, however, for example as described in U.S. Pat. No. 5,191,712, WO 97/25190 and WO 97/33729, the contents of which are incorporated herein by reference, and the material of the elastomeric strip may be as mentioned in U.S. Pat. No. 5,249,361, the contents of which are also incorporated herein by reference.

Behind the elastomeric strip 14 the front frame member 11 defines a backstop 16 (or guard) which, as the skin contacting surface just before the first blade, serves an important role in establishing certain parameters of the shaving geometry of the blade unit, and in particular the blade span $S_1$ of the first blade, which is measured from the top rear edge 17 of the backstop 16. The rear member 12 of the frame includes a cap 42 and carries a lubricating strip 18 incorporating a lubricant which is leached out of the strip on contact with water. The composition of the lubricating strip 18 may be as described in U.S. Pat. No. 5,113,585, the contents of which are incorporated herein by reference. Mounted within the central opening of the frame are three blade assemblies providing first, second and third blades 19, 20, 21 with parallel forwardly directed cutting edges 24, 25, 26. Each blade 19, 20, 21 consists of a substantially planar metal strip fixed, e.g., spot welded, to a support bar 28. The blade support bar 28 has parallel front and rear faces 30 and 31, a bottom face 32, which is perpendicular to the front and rear faces, and a top face 33 to which the blade is attached and which is forwardly and upwardly inclined, the angle between the front and top faces being about 67.5° so that the blade is inclined at an angle of about 22.5°.

The support bar 28 has downwardly directed legs 29 at its ends, these legs being slidably received in slots 35 formed in the inner faces of the frame ends 13. Springs 36 are positioned to act on the lower ends of the legs 29 and urge the blade support and blade upwardly to a normal rest position, the upward movement being limited by engagement of the blade with stop shoulders 37 formed on the frame ends 13. Thus, the blades 19, 20, 21 are supported in the blade unit frame 10 for vertical movement independently of each other under the forces encountered during shaving. Although the blade unit of FIGS. 4 and 5 differs in certain details, especially with regard to the form of the blade supports and the positioning of the blades as described in further detail below, the blade unit is generally similar to the blade units described in our previous patent applications Nos. WO 97/37819, WO 99/16591 and WO 99/16592, the contents of which are incorporated herein by reference and to which reference can be made for further information on the blade unit construction.

It should be noted that the support bars 28 are narrower than the blades they support and are confined within the width of the blades, this being an important contribution to achieving a wash through index value of at least 0.20 in accordance with the essential teaching of the present invention. The support bars 28 position the blades 19,20,21 so that, in their normal rest positions when the blade edges lie substantially in a common plane, the cutting edge 24 of the first blade 19 is spaced from the rear edge 17 of the backstop 16 at a primary span $S_1$ of 0.7 mm, the cutting edge 25 of the second blade 20 is spaced from that of the first blade at an inter-blade span $S_2$ of 1.11 mm, and the cutting edge 26 of the third blade is spaced behind that of the second blade at an inter-blade span $S_3$ of 1.11 mm. Thus, $$\text{Average inter-blade span} = \frac{S_2 + S_3}{2} = 1.11 \text{ mm}$$

Figure 1:
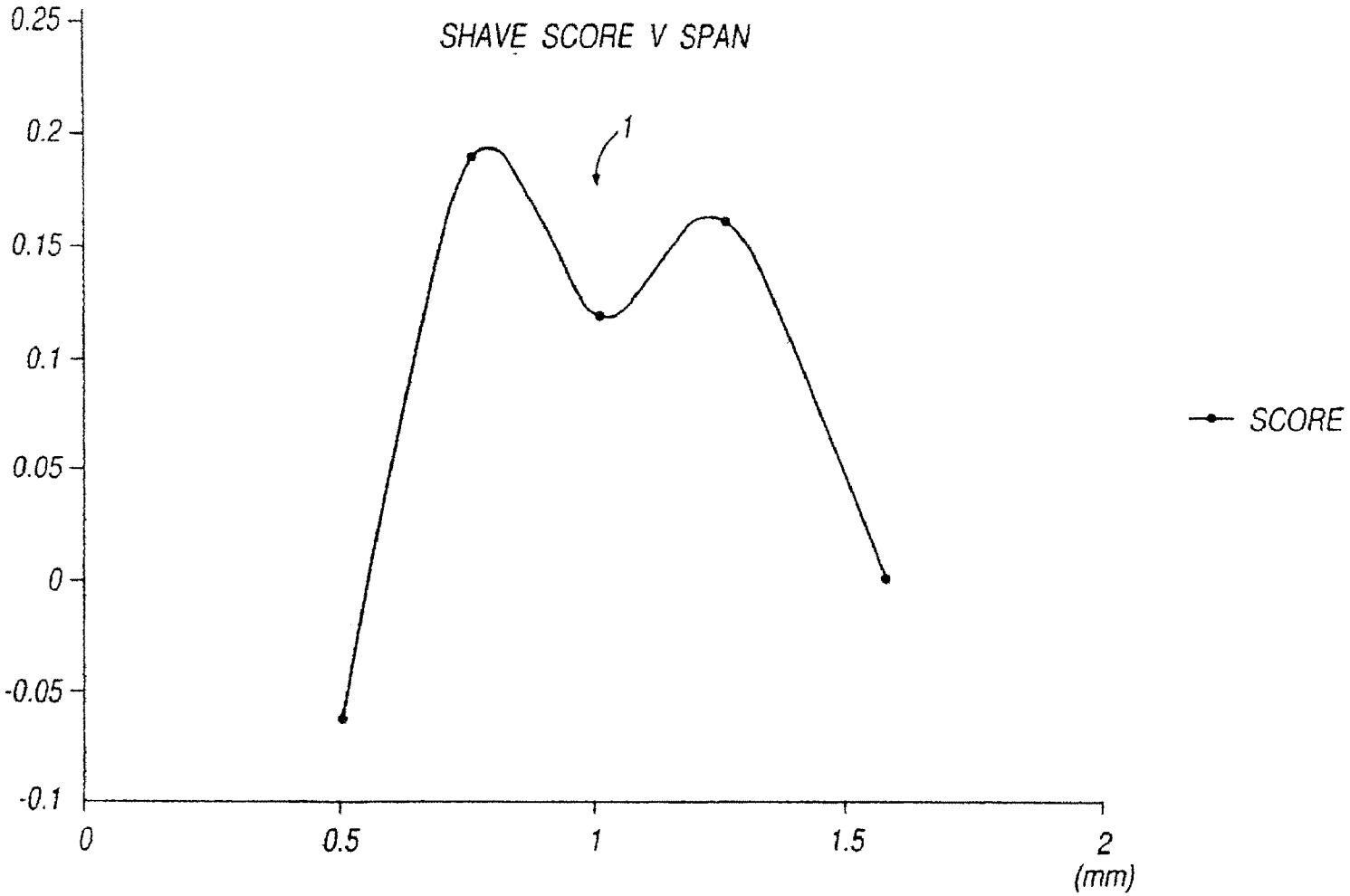
FIG. 1 is a graph showing shaving comfort preference plotted against blade span as already discussed fully in the preceding description.
Figure 2:
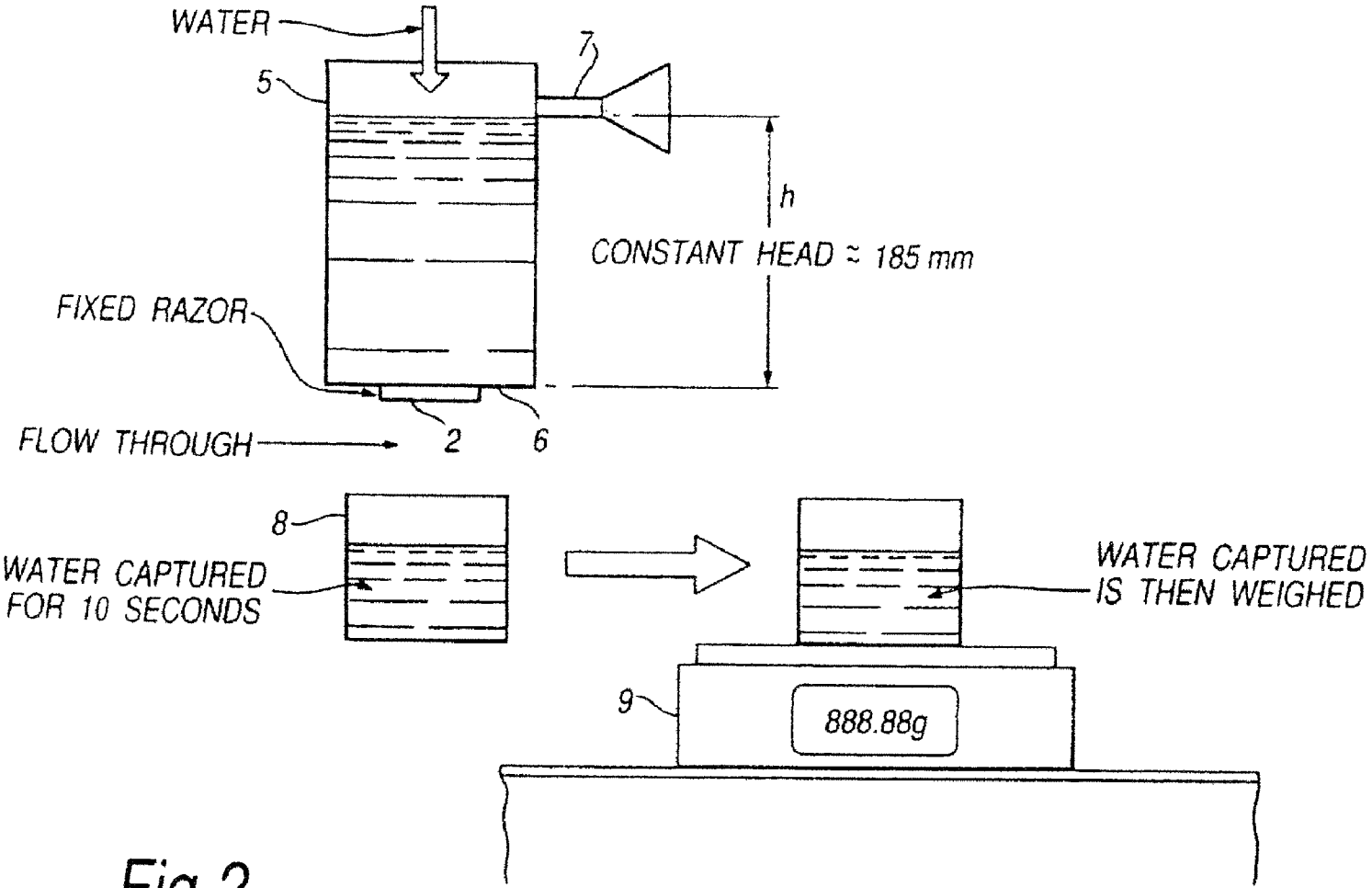
FIG. 2 is a schematic illustration of the apparatus employed in determining the wash through index of a safety razor blade unit by means of the method as described above.
Figure 3:
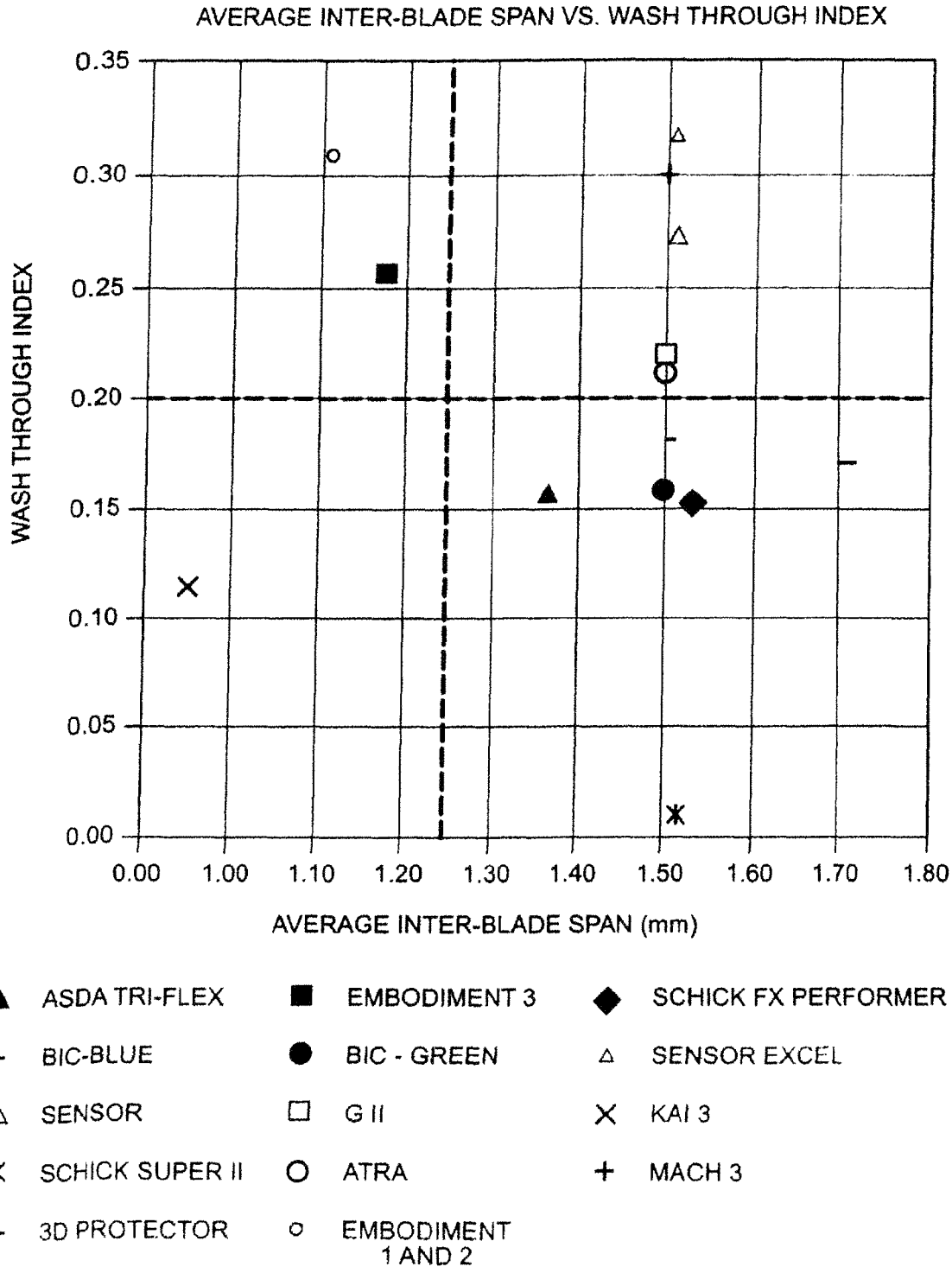
FIG. 3 is a chart showing the results of wash through index measurements for several blade units plotted against average inter-blade span as explained in the foregoing description.

The wash through index for the blade unit of FIGS. 4 and 5 was measured by the method as described hereinabove and produced a value of 0.32. These results are depicted on the chart of FIG. 3 on which the blade unit described with reference to FIGS. 4 and 5 is identified as Embodiment 1.

Figure 6:
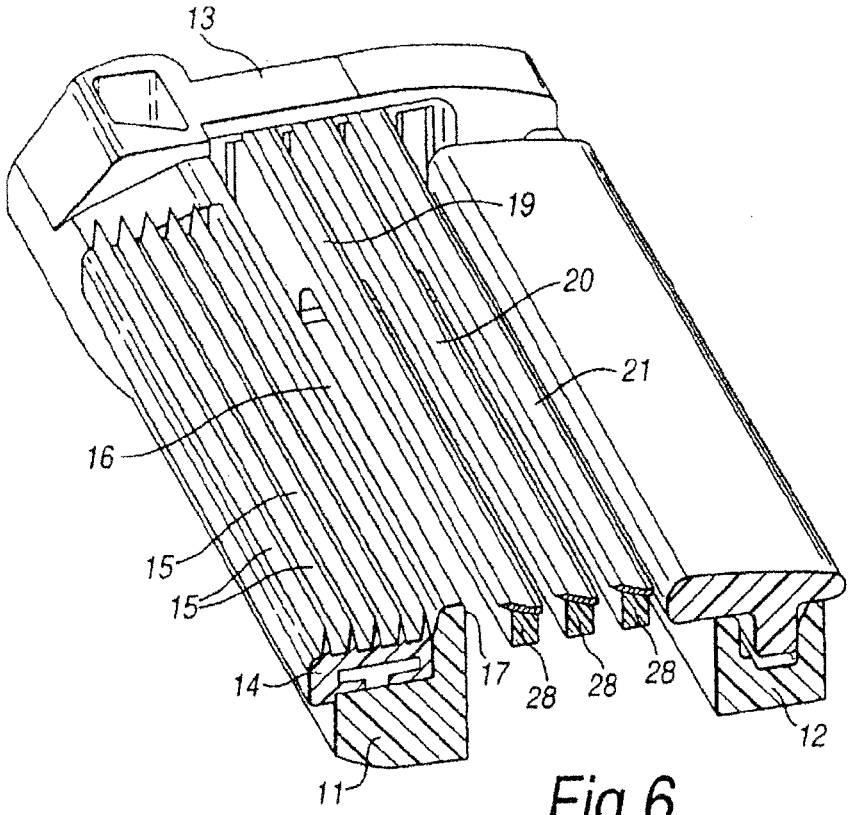
FIG. 6 is a view similar to FIG. 4 showing a second three-bladed blade unit according the invention.
Figure 7:
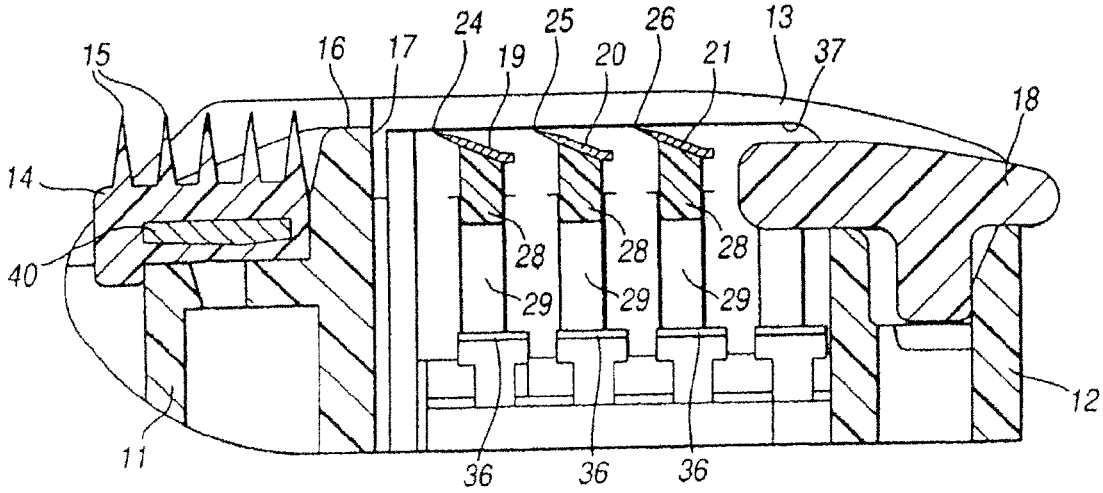
FIG. 7 is a transverse cross-section through the blade unit of FIG. 6.

The blade unit shown in FIGS. 6 and 7 is for the most part the same as that as FIGS. 4 and 5 and except as explained below can be taken to be as described above. An enlarged lubricating strip 18 is provided which defines a much larger surface for contact with the skin during shaving to enhance lubricant delivery to the skin, and has a greater volume for holding more lubricant available to be discharged during the life of the blade unit. The front-to-back width of the lubricating strip is more than three times the average inter-blade span. The elastomeric strip 14 has five upstanding fins 15 rather than four and has a reinforcing insert 40. The blade assemblies are unchanged and are disposed within the frame 10 of the blade unit at the same primary and inter-blade spans as mentioned in relation to the blade unit of FIGS. 4 and 5. Consequently, this blade unit features the same average inter-blade span and the same wash through index as that of FIGS. 4 and 5, and it is identified as Embodiment 2 on the chart of FIG. 3.

Figure 8:
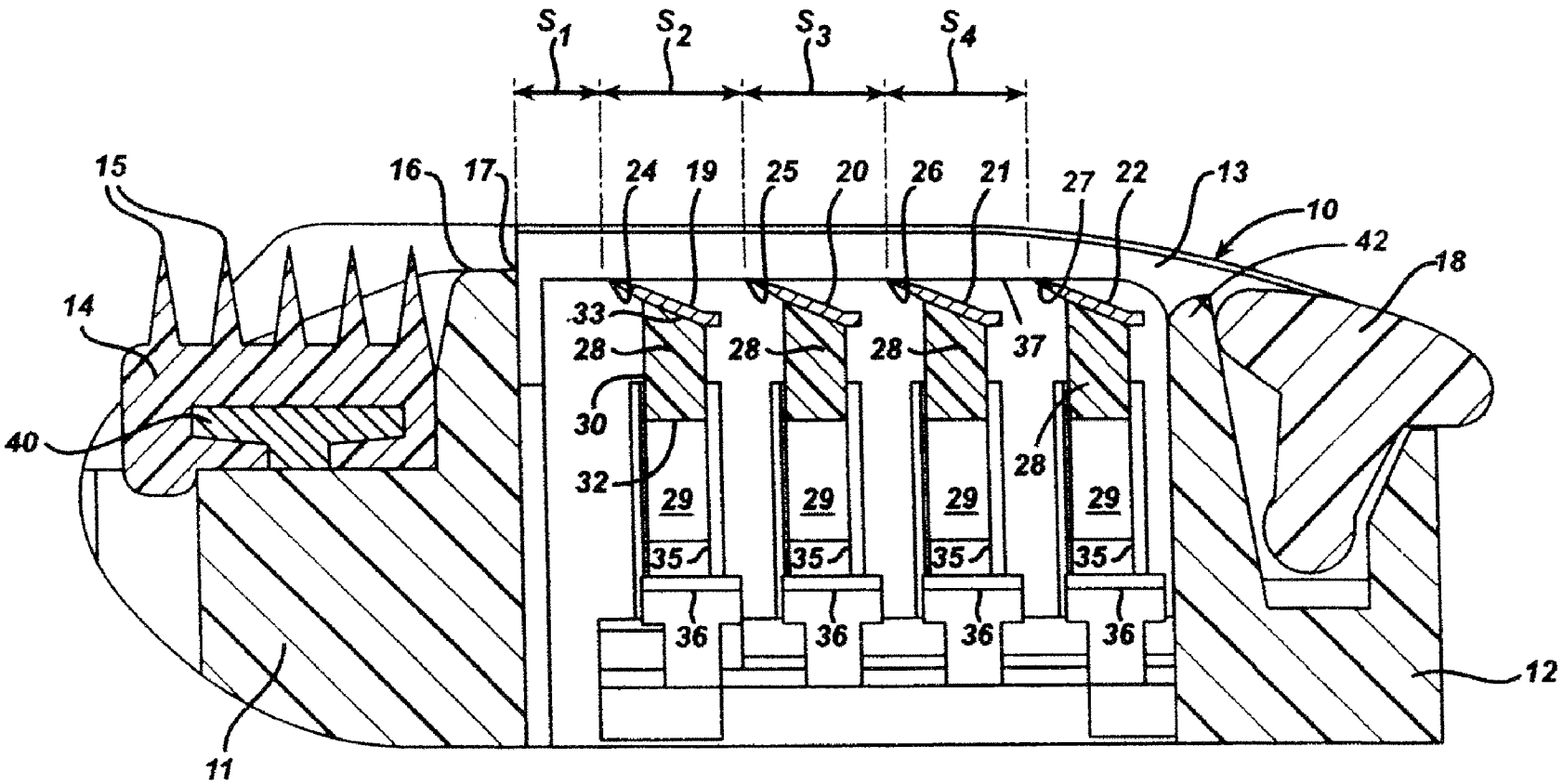
FIG. 8 is a transverse cross-section through a blade unit with four blades which embodies the invention.

A blade unit with four parallel blades is illustrated in FIG. 8. The blade unit includes a moulded plastic frame 10 with front and rear members 11, 12 interconnected by frame ends 13. The front member 11 includes a guard 16 with a skin contacting surface and has an elastomeric strip 14 with five fins 15 and a reinforcing insert 40. The rear member 12 includes a cap 42 with a skin contacting surface and carries a lubricating strip 18. The blade assemblies are the same as described above in connection with the earlier embodiments, and the fourth blade 22 is arranged so that its cutting edge 27 is spaced from that of the third blade at an inter-blade span $S_4$. In this embodiment the inter-blade spans are substantially equal with $S_2=S_3=S_4=1.18$ mm. Thus, $$\text{Average inter-blade span}=S_2+S_3+S_4/3=1.18 \text{ mm}.$$

The primary span $S_1$ is 0.70 mm.

As shown in FIG. 8, the blade edges (24, 25, 26, and 27) of the four blades at rest lie substantially in a common plane. In addition, with respect to a plane tangent to the skin contacting surfaces of the guard and cap, the first blade edge 24 is positioned below the plane and the fourth blade edge 27 is positioned above the plane. As to blade exposure, the first blade edge 24 (nearest the guard) has a negative exposure (i.e., the tip lies below a plane tangent to the guard surface and second blade tip) and the fourth blade edge 27 (nearest the cap) has a positive exposure (i.e., the tip lies above a plane tangent to the third blade tip and the cap surface).

The wash through index of the blade unit of FIG. 8 as determined by the method described hereinabove is 0.26. The blade unit of FIG. 8 is identified on the chart of FIG. 3 as Embodiment 3.

Of course the blades 19,20,21 and 22 in the blade unit of FIG. 8 could be positioned at uniform inter-blade spans of less than 1.18 mm, such as at the same inter-blade span of 1.11 mm as in the blade units of FIGS. 4-6. With the average inter-blade span in this order four blades can be accommodated while still achieving the desired rinsability, as shown by the wash through index measurements, and without the front-to-back overall width of the blade unit becoming unacceptably large.

Other details of the blade unit of FIG. 8 will be understood from the description of the previous embodiments.

It will be appreciated that modifications to the specifically described embodiments which are given by way of non-limiting example only are possible without departing from the principles of the invention and it is the intention that the scope of the invention should be limited only by the claims which follow.

It will be appreciated that the blade units embodying the invention will be carried on razor handles when used for shaving, and so as not to detract from the rinsability characteristics the razor handle, and in particular the connection between the handle and the blade unit, should be arranged so as not to impede flow of rinsing water through the blade unit. Suitable forms of connection for attaching the particularly described blade units to a handle are those described in the prior applications Nos. WO 97/37819 and WO 98/36880, the contents of which are incorporated herein by reference.

What is claimed is:

1. A safety razor blade unit comprising:

a frame, said frame comprising frame ends, each one of the frame ends comprising multiple slots and a stop shoulder, at least four blades supported by the frame, the blades having respective forwardly directed cutting edges extending along the blade unit, each one of the blades being positioned within a respective one of the multiple slots in each one of the frame ends, a guard structure on the frame providing a surface for contact with skin during shaving forward of the blades, a cap structure on the frame providing a surface for contact with the skin during shaving rearward of the blades, the blades are vertically movable from rest positions within the slots under forces imparted on the blades during shaving and the blades are movable independently of each other against actions of respective return springs, and in the rest positions the blades are arranged so that the cutting edge of each of said blades contacts said stop shoulder to lie substantially in a common plane extending between the contact surfaces of the guard structure and cap structure.

2. The safety razor blade unit according to claim 1, wherein said blades include an inter-blade span between adjacent ones of said blades.

3. The safety razor blade unit according to claim 2, wherein the inter-blade span of the blades are uniform.

4. The safety razor blade unit according to claim 1, wherein each of said blades comprise a substantially planar strip carried on a respective blade support.

5. The safety razor blade unit according to claim 4, wherein each of said blade supports is narrower than the planar strip it carries.

6. The safety razor blade unit according to claim 4, wherein each of said blade supports comprises a bar with parallel front and rear faces and a forwardly and upwardly inclined top face.

7. The safety razor blade unit according to claim 1, wherein the guard structure includes a strip of elastomeric material.

* * * * *